US008127495B2

(12) United States Patent
Eckhardt et al.

(10) Patent No.: US 8,127,495 B2
(45) Date of Patent: Mar. 6, 2012

(54) WINDOW LIFT SYSTEM AND METHOD FOR FITTING A WINDOW PANE

(75) Inventors: Bernhard Eckhardt, Wetzlar (DE); Bernhard Sielhorst, Sontra (DE); Enrico Schliwa, Lauchroden (DE); Harald Kollner, Altenstadt (DE)

(73) Assignee: Faurecia Innenraum Systeme GmbH, Hagenbach (DE)

( * ) Notice: Subject to any disclaimer, the term of this patent is extended or adjusted under 35 U.S.C. 154(b) by 767 days.

(21) Appl. No.: 10/593,738

(22) PCT Filed: Apr. 1, 2005

(86) PCT No.: PCT/EP2005/003614

§ 371 (c)(1),
(2), (4) Date: Sep. 19, 2006

(87) PCT Pub. No.: WO2005/095745

PCT Pub. Date: Oct. 13, 2005

(65) Prior Publication Data

US 2009/0000202 A1 Jan. 1, 2009

(30) Foreign Application Priority Data

Apr. 2, 2004 (DE) ..... 10 2004 017 645

(51) Int. Cl.
*E05F 11/48* (2006.01)

(52) U.S. Cl. ..... 49/352

(58) Field of Classification Search ..... 49/348, 49/349, 352, 374, 375, 502; 296/146.7; 16/86 R
See application file for complete search history.

(56) References Cited

U.S. PATENT DOCUMENTS

| | | | | | |
|---|---|---|---|---|---|
| 2,015,622 | A * | 9/1935 | Evulich | 16/86 A |
| 4,001,971 | A * | 1/1977 | Gobush et al. | 49/352 |
| 4,644,695 | A * | 2/1987 | Shiraishi et al. | 49/352 |
| 4,984,386 | A * | 1/1991 | Marscholl et al. | 49/352 |
| 5,001,867 | A * | 3/1991 | Dupuy | 49/502 |
| 5,067,281 | A * | 11/1991 | Dupuy | 49/502 |
| 5,174,066 | A * | 12/1992 | Dupuy | 49/502 |
| 5,528,861 | A * | 6/1996 | Beyerlein | 49/352 |
| 5,992,099 | A * | 11/1999 | Thomas | 49/375 |
| 6,088,965 | A * | 7/2000 | Fukumoto et al. | 49/352 |
| 7,424,788 | B2 * | 9/2008 | Kirejczyk | 49/352 |
| 7,610,720 | B2 * | 11/2009 | Kirejczyk et al. | 49/352 |
| 7,797,882 | B2 * | 9/2010 | Lubaway | 49/352 |
| 2002/0083647 | A1 * | 7/2002 | Bostian et al. | 49/352 |

OTHER PUBLICATIONS

Single. (n.d.) Collins English Dictionary—Complete and Unabridged 6th Edition 2003. (1991, 1994, 1998, 2000, 2003). Retrieved Mar. 12, 2010 from http://www.thefreedictionary.com/single.*

* cited by examiner

*Primary Examiner* — Jerry Redman
(74) *Attorney, Agent, or Firm* — Fay Kaplun & Marcin, LLP

(57) ABSTRACT

A window lift system, especially for the side window of a motor vehicle, includes (i) a pulling device and (ii) a catch for a window pane, which can be moved up and down using the pulling device. The catch has a first fastening point for an upward pulling end of the pulling device and a second fastening point for a downward pulling end of the pulling device, which point is horizontally off-set from the first fastening point in the window pane plane when the window pane is fitted. The window lift system also includes (iii) an arrangement positioning and fixating the catch in terms of at least three degrees of freedom so that the catch can be maintained in a position that is defined in terms of the degrees of freedom even when the window pane is not yet fitted.

16 Claims, 2 Drawing Sheets

WINDOW LIFT SYSTEM AND METHOD FOR FITTING A WINDOW PANE

FIELD OF INVENTION

The present invention relates to a window lift system, especially a window lift system for a side window of an automotive vehicle, comprising a catch for a window pane which can be moved up and down by a pulling device, in accordance with the preamble of the main claim. The present invention relates furthermore to a door or side panel module which contains such a window lift system, as well as to a method for fitting a window pane in such a window lift system.

BACKGROUND INFORMATION

In a window lift system of this type, the catch has a first fastening point for an upwardly pulling end of the pulling device and a second fastening point for a downwardly pulling end of the pulling device, this second point being horizontally offset to the first fastening point in the window pane plane once the window pane is fitted. Such a window lift system is known from the publication DE 690 27 127 T2.

Window lift systems of this type are of particular interest when fastening of the upwardly pulling end and the downwardly pulling end of the pulling device at two fastening points on the catch which are horizontally offset in the above-mentioned manner ensures that a drive force for movement is so applied to the window pane that, independently of the direction of movement, the window pane is always pressed against merely a single guiding edge or rail which remains the same for each direction of movement. Tilting of the window pane in a corresponding guiding device can thus be effectively prevented.

A window lift system designed in this way is proposed in the German patent application DE 102 55 461.7 which had not been published on the application day of the present application. The invention described below is suitable especially for window lift systems of the type proposed in that patent application, the content of which is hereby entirely incorporated by reference into the present application.

Window lift systems of the type thus described bring with them a problem which forms the starting point for the present invention. In such window lift systems, torque is exerted on the window pane independently of the direction of pulling and movement. This torque is typically also desired in order to press the window pane constantly against the same guiding edge or rail. The same torque transferred via the catch to the window pane once the window pane is fitted, however, results in the catch being pulled, before the fitting of the window pane, into an oblique position which makes fitting the window pane extraordinarily difficult, especially connecting the window pane to the catch. Fitting the window pane is also made more difficult in that the catch which previously was typically only held by the two ends has at least one degree of rotational freedom, and can thus rotate freely at least about one axis. This can furthermore lead to undesired rattling when the corresponding door or side panel module which contains a corresponding window lift system is transported.

SUMMARY OF INVENTION

The present invention relates to a window lift system which continue to be suitable for transferring torque in the depicted manner to the corresponding window pane. Furthermore, the present invention relates to a practical method for fitting a window pane in a window lift system of this type.

Because a window life system according to the invention has means for positioning and fixing the catch at least in respect of three degrees of freedom, so that the catch can be held in a position defined in respect of these degrees of freedom even when the window pane is not fitted, the fitting of the corresponding window pane is decisively simplified. A corresponding advantageous fitting method for the window pane in such a window lift system provides for the catch to be initially positioned and fixed in respect of the mentioned degrees of freedom using the means provided for this purpose, and for the window pane to be then introduced into the window lift system until the window pane and the catch assume positions which correspond to each other (in a suitable window lift system according to the invention this can happen virtually automatically by introducing the window pane sufficiently far), and provision is also made for the window pane then to be connected to the catch as a form-fit and/or in a force-locking manner.

In embodiments of the invention, the catch has an upwardly open slit for receiving a lower edge of the window pane. As the window pane is being fitted and after the positioning and fixing of the catch from above (direction indications and relative location indications should always relate to the installation or operating state of the window lift system), the window pane can then be introduced so far into the window lift system that the lower edge of the window pane has travelled from above into the slit in the catch. Introducing the window pane (from above in typical window lift systems and corresponding fitting methods) can take place before or after the installation of the window lift system in a door or a vehicle side panel.

Simple and reliable connection of the window pane to the catch can be effected in that the catch has a single locking element or a plurality of locking elements for snapping into at least one corresponding recess in the window pane. A form-fit connection then comes about virtually automatically due to the introduction of the window pane.

Alternatively or additionally, an opening or two facing openings can be provided in the catch and a recess or recesses in alignment with this opening or these openings once the window pane is fitted can be provided in the window pane, through which opening(s) a pin or bolt can be pushed to connect the window pane to the catch. This pin or bolt should fit as exactly as possible in the corresponding openings or recesses. Such a pin joint or screw-bolt connection can ensure a particularly reliable force transmission from the ends of the pulling device to the window pane. Good force transmission is here particularly desirable for the downwardly pulling end of the pulling device, since a downwardly directed tractive force could tend to pull the catch away from the window pane. If a single pin joint or screw-bolt connection of the described type is provided, it is therefore expedient so to arrange this connection that it can in particular absorb forces emanating from the downwardly pulling end of the pulling device. In advantageous embodiments of the invention, however, two such pin joints or screw-bolt connections can be provided which are arranged horizontally offset and guarantee a torque-proof connection of the catch to the window pane. The connection of the window pane to the catch in such a device can then come about in that each pin or bolt is pushed through the corresponding openings or recesses when the window pane and the catch have assumed positions corresponding to each other after the introduction of the window pane into the window lift system.

Particularly expedient embodiments of the invention provide for the described window lift system to be a constituent part of a door or side panel module or to be arranged on such a door or side panel module before the window pane is fitted and before the corresponding door or side panel module is fitted. Such a module can have a panel part which, for stability reasons, is preferably formed from a fibre-reinforced plastics material, which can in turn be moulded or injection-moulded. With a view to economical manufacturing and simple fitting, those embodiments in which at least some of the mentioned means for positioning and fixing the catch and/or other components of the window lift system are integrally moulded onto this panel part as one piece are particularly advantageous. In particular with a combination of window lift systems according to the invention with such door or side panel modules, in addition to the advantage of simplified fitting, a further advantage applies in that using the means for positioning and fixing the catch can prevent undesired clattering of the catch during transportation of the window lift system or of the door or side panel module. Thus ultimately also damage can be avoided which otherwise could be caused by a catch knocking around freely in the event of jolts during transportation.

The advantages of a window lift system of the described type come to bear above all with so-called rail-less window lift systems or with window lift systems which have window panes guided only on one side (for example on a single rail or guiding edge). With such or similar window lift systems it is namely crucial that, through an arrangement of two offset fastening points for the two ends of the pulling device, a uniformly directed torque can be transmitted to the window pane independently of the direction of movement.

From what has been said so far it follows that in advantageous embodiments of the invention the catch should be able to be positioned sufficiently exactly, even when the window pane is not yet fitted, to make possible a reliable bringing-together of the catch and the window pane which can as far as possible also come about automatically as the window pane is introduced. To this end it is not absolutely necessary for the catch to be fixed in respect of all conceivable (six) degrees of freedom. Depending on the dimensions and relative arrangement of the various components of the window lift system, it can be sufficient if the catch is able to be positioned and fixed in this sense in respect of three degrees of freedom. Various advantageous embodiments of the invention can also be so designed that the catch can be positioned and fixed in respect of four, five or even all six degrees of freedom by the above-mentioned means.

In a window pane fitting method according to the invention, the catch can, especially in those embodiments which permit positioning and fixing of the catch in respect of all six degrees of freedom, advantageously be fixed, before the introduction of the window pane, in a position which corresponds to a possible position of the catch once the window pane is fitted. This can be a lowermost position of the catch which corresponds to a completely open window, but this is not necessarily the case.

In other embodiments of methods according to the invention, provision can be made for the catch to be, in respect of at least one degree of freedom, not yet fixed in a position which corresponds to a position of the catch once the window pane is fitted, and for the catch only to be pressed into the above-mentioned position by the introduction of the window pane, in which position then the connection of window pane and catch can take place. When the catch is so shaped that it has an upwardly opening slit for receiving the lower edge of the window pane, independently of the exact embodiment of the fitting method and of the number of degrees of freedom in respect of which the catch is positioned and fixed before the introduction of the window pane, it is in every case helpful if, for introducing the window pane, the catch is held in a position in which the above-mentioned slit lies in a plane or area defined by the window pane. Then bringing together the window pane and catch for the purpose of connecting the two is unproblematic.

In typical embodiments of the invention, the pulling device will have a cable pull or a chain, so that the upwardly pulling end and the downwardly pulling end of the pulling device each form one end of this cable pull or chain. A wire or plastic cable suggests itself for example as the cable pull, with a view to as high tensile stability as possible, low linear extensibility and good flexibility. Possible, too, are those embodiments in which two independent pulling devices, for example cable pulls or chains, are provided each for one end fastened to the catch. The pulling device of a window lift system of the described art typically has furthermore deflections formed for example by rollers and/or sliding blocks, as well as a drive system provided e.g. by a crank drive or an electric motor.

The means for positioning and fixing the catch can be designed in various ways. In particularly simple embodiments, these means can for example be provided by a lower stop for the catch or have such a lower stop or even two such stops. Positioning and fixing the catch before introducing the window pane can then come about in a simple manner in that the catch is pulled by the downwardly pulling end of the pulling device against this stop or these stops and held there by the same end. It is conceivable here that the catch already abutting against the stop at one end initially remains in an inclined position and is only pressed by the window pane into a position in which it is correctly orientated. In other embodiments, provision can be made for the catch to be pulled out of a possible inclined position even before the introduction of the window pane by the downwardly pulling end of the pulling device, for which purpose the downwardly pulling end of the pulling device, cooperating with the stop, exerts torque on the catch. As a supplement to a lower stop or even a plurality of lower stops for the catch, as further constituent parts of the means for positioning and fixing the catch, guiding means can also be provided for the lateral guidance of the catch at least in a lower movement section in the vicinity of the lower stop or stops. The term "lateral guidance" is here intended to refer in particular to guidance of the catch which limits the freedom of movement of the catch in a direction perpendicular to the plane defined by the window pane. Such guiding means can, however, also serve to position the catch in a longitudinal direction. The guiding means can here be designed for example, in a manner which is simple to realise, by walls guiding the catch laterally and preferably converging downwards in the manner of a funnel. In addition or alternatively, a cone can also be provided on which the catch sits in a lowermost position. Even more precise and reliable positioning can be achieved if two such cones are provided; instead of cones naturally also elements of other upwardly tapering geometries can be considered which are so positioned that the downwardly moving catch sits on same via a depression, bore or recess.

Instead of a lower stop, an upper stop and possibly guiding means for the lateral guidance of the catch could be provided in an upper movement section in the vicinity of the upper stop as means for positioning and fixing the catch, functioning in a similar way to the fitting of the window pane in an upper position which corresponds to a completely closed window.

When the window lift system is integrated in a door or side panel module or is arranged on such a module, the positioning and fixing means can also be provided by an opening or a plurality of openings in a panel part of this module and in each case by a corresponding opening in the catch, as well as by a pin each which can be pushed through the mutually corresponding openings to fix the catch in a defined fitting position. It is also possible for the means for positioning and fixing the catch to include these features in addition to other features such as guiding means for example. The above-mentioned fitting position should correspond here to a possible position of the catch once the window pane is fitted; this position can, but does not have to, correspond to the lowermost position of the catch.

Positioning which is advantageous because it can be defined in respect of all the degrees of freedom is produced if two pins are provided which can each be pushed through an opening in the catch and a corresponding opening in the panel part. The pins can be simple bolts or also screws, preferably headless screws. Then at least one of two corresponding openings should be provided with a thread matching the screw. Such a screw can be screwed through the door or side panel module into the catch or also through the catch into the door or side panel module. In the first case it is sufficient if the corresponding opening in the catch is designed merely as a depression; correspondingly in the second case it is sufficient if the opening in the door or side panel module is not designed as a complete recess but only as a depression (the same is true if a simple bolt is used as the pin instead of a screw).

A door or side panel module of the described art usually serves as a partition between a wet side and a dry side of an automotive vehicle door or side panel. When therefore such a module is provided with an opening in the described manner, advantageously care should be taken to ensure that this opening remains or is sealed after the window pane has been fitted. For this purpose such an opening can be sealed with a plug after the corresponding pin has been removed; however it is also possible for a screw, which has previously been used as means for fixing the catch, to be screwed back after the fitting of the window pane only so far that the catch is released, but the opening remains sealed by the screw.

In similar embodiments of door or side panel modules according to the invention or of methods according to the invention for fitting a window pane, openings can also be provided in the corresponding panel part of the module, through which openings a tool can be guided instead of pins, said tool being capable of gripping the catch and positioning and fixing same during fitting relative to the panel part and thus to the door or side panel module.

Particularly advantageous applications of the present invention arise especially through a combination of the essential features of the invention with those window lift systems which are claimed and described in the already-mentioned patent application DE 102 55 461.7. Through such a combination, particularly advantageous embodiments of window lift systems and door or side panel modules according to the invention are produced. Correspondingly, the method described here is particularly suitable for fitting a window pane in a window lift system of this type. The content of the application DE 102 55 461.7, which is referred to in this connection, is hereby incorporated into the present application.

BRIEF DESCRIPTION OF DRAWINGS

Embodiments of the present invention are explained in greater detail below with the aid of FIGS. 1 to 3. The figures show.

DETAILED DESCRIPTION

Figure 1:
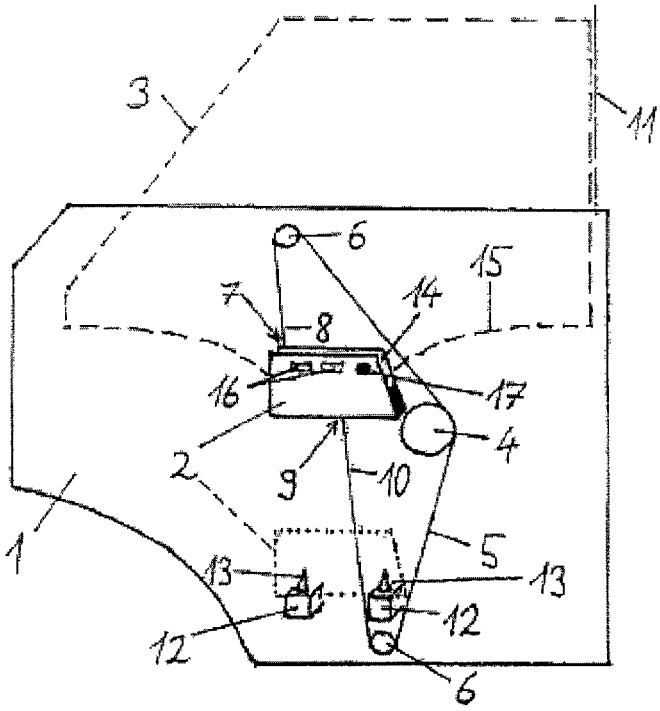
FIG. 1 shows a stylised front elevation of a door module for a front left-hand side door of an automotive vehicle with a window lift system according to an exemplary embodiment of the present invention.

Thus in FIG. 1 a door module is illustrated which is intended to be installed in the left-hand front side door of an automotive vehicle. This door module has a panel part 1 formed from an injection-moulded fibre-reinforced plastic on which a window lift system is arranged and which at the same time serves as a partition between a wet region and a dry region, covered by the panel part in the figure, of the corresponding side door. The window lift system has a catch 2, which can be moved up and down by a pulling device, for a window pane 3 indicated with a broken line in the figure. Recognisable in the figure as constituent parts of the pulling device are a drum, which may be driven by a crank drive, not shown, or an electric motor, a traction cable 5 wound over this drum 4 and therefore mobile, as well as two deflection elements for the traction cable 5 in the form of rollers. In other embodiments of the invention, the deflection elements 6 can also be in the form of sliding blocks.

The traction cable 5 is in the form of a plastic cable; corresponding embodiments with a wire cable or even a chain instead of the traction cable 5 would also be possible. The traction cable 5 is fastened to the catch 2, said catch 2 having a first fastening point 7 for an upwardly pulling end 8 and a second fastening point 9 for a downwardly pulling end 10 of the cable 5. As can be seen in FIG. 1, when the window pane 3 is fitted, the second fastening point 9 is arranged horizontally offset from the first fastening point 7. In the depicted window lift system and also other window lift systems of this type, this ensures that the window pane 3 is pressed by torque exerted by the traction cable 5 via the catch 2 on the window pane 3 independently of the direction of movement, i.e. independently of whether the window pane 3 is pulled upwards or downwards, always against the same guiding edge or rail 11 which is only indicated in FIG. 1.

In addition, the illustrated window lift system has means for positioning and fixing the catch 2, with the aid of which the catch can be held in a defined position even when the window pane has not yet been fitted. In the illustrated embodiment of the invention, these means for positioning and fixing the catch 2 are provided by two supports 12 which are integrally moulded onto the panel part 1 as one piece and serve as lower stops for the catch 2. On each of these supports 12 is moulded in turn a cone 13, these cones 13 being so arranged that the catch 2 rests on these cones 13 with two openings, which are arranged at the bottom of the catch 2 but not recognisable in FIG. 1, when the catch assumes a lowermost position. In this lowermost position of the catch 2, which is indicated by a dotted contour in FIG. 1, the catch 2 rests on the supports 12. During a downward movement of the catch 2, the cones 13 serve as guiding means for the catch 2 during a last movement section shortly before the lowermost position is reached.

Before a window pane 3 is fitted, the catch 2 is initially held only by the upwardly pulling end 8 and the downwardly pulling end 10 of the traction cable 5. Due to an offset arrangement of the first fastening point 7 and the second fastening point 9, the catch is here normally pulled into an oblique position and can also rotate freely within certain limits about an axis then defined by the upwardly pulling end 8 and the downwardly pulling end 10. If further measures are dispensed with, that would not only lead to the catch 2 knocking about freely in an undesired manner during transportation of the door module and possibly causing damage but in addition the fitting of the window pane 3 and especially connecting the window pane 3 to the catch 2 would only be possible with extraordinary difficulty. Due to the design of the window lift system with the supports 12 and the cones 13 as means for positioning and fixing the catch or as guiding means, however, the catch 2 can now be pulled, for transportation of the door module or for fitting the window pane 3, into the lowermost position, resting then initially, pulled downwards by the downwardly pulling end 9, on the support 12 lying on the right in FIG. 1, and then being pulled out of an inclined position by the downwardly pulling end 10 until it also comes to rest on the support 12 lying on the left in FIG. 1. In this process it is guided laterally by the cones 13 in such a way that the catch 2 then also assumes a position which is already defined in respect of all six degrees of freedom even if the window pane 3 is not yet fitted. Knocking about of the catch 2 caused by jolts during transportation is thus avoided and the fitting of the window pane 3 is considerably facilitated.

The catch 2, an injection-moulded plastics part, has an upwardly open slit 14 for receiving a lower edge 15 of the window pane 3. In order to make possible the connection of the window pane 3 and the catch 2 as a form-fit, the catch has in addition two locking elements 16 for snapping into two recesses in the window pane 3 which are not recognisable in the figure. In addition, an opening 17 is provided in the catch 2 which, for connecting the catch 2 to the window pane 3, can receive as an exact fit a pin which at the same time engages through a recess in the window pane 3 which is in alignment with this opening 17 when the window pane 3 is fitted. A form-fit connection of the catch 2 and the window pane 3 is then produced both by the locking elements 16 and by the above-mentioned pin.

The window pane 3 can now be fitted in an advantageous manner in the illustrated window lift system by the catch 2 being first positioned in the described manner and fixed in respect of all the degrees of freedom by being pulled by the downwardly pulling end 10 of the traction cable 5 into its lowermost position and thus onto the supports 12 with the cones 13. Thereafter the window pane 3 can be introduced into the window lift system until the window pane 3 and the catch 2 assume positions which correspond to each other, i.e. in the depicted example until the window pane 3 also assumes a lowermost position. In this process, a form-fit connection of the catch 2 and the window pane 3 is produced virtually automatically in that the locking elements 16 snap into the corresponding recesses in the window pane 3. An even better connection can by produced by the already-mentioned pin (or bolt) being pushed through the opening 17 and the recess in the window pane 3 which corresponds to this opening 17. Because the catch is positioned and fixed in a defined position before the window pane 3 is introduced, the lower edge 15 of the window pane 3 travels virtually automatically into the slit 14 in the catch 2 as the window pane 3 is introduced, without the catch 2 having to be held manually in an expensive manner for this purpose.

Figure 2:
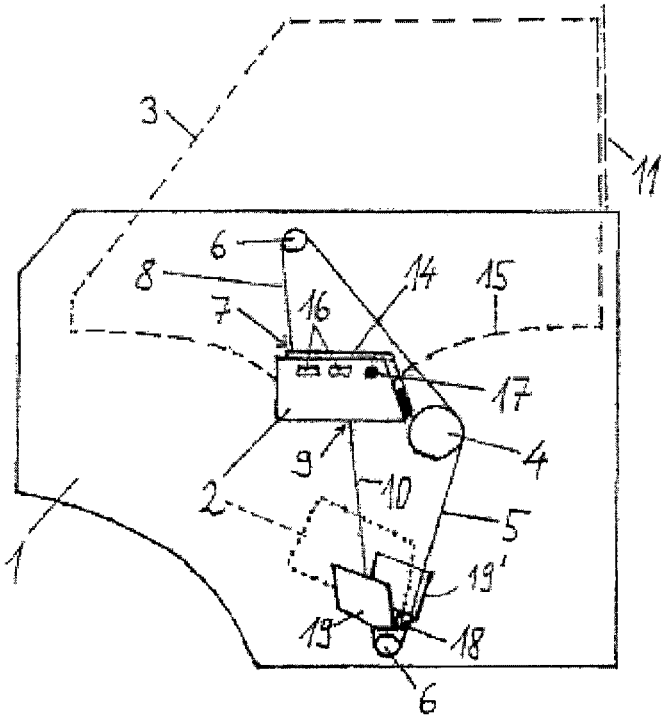
FIG. 2 shows a door module according another exemplary embodiment of the present invention.

Another embodiment of the invention is shown in FIG. 2. There, too, a door module for an automotive vehicle is illustrated in a corresponding view. Recurring features are here and in the following figure provided with the same reference numerals and are not specifically explained any more. Differing from the previously described embodiment, the means for positioning and fixing the catch 2 are here provided by a single lower stop 18 and two walls 19 and 19' communicating with this lower stop 18, serving as guiding means and laterally guiding the catch 2 on a lower section of a downward movement. The two walls 19 and 19' converge downwards in a funnel-like manner.

The window lift system illustrated in FIG. 2 is here so designed that, for fitting the window pane 3, the catch 2 is only positioned and fixed in respect of five of six degrees of movement. For this purpose it is again pulled downwards by the downwardly pulling end 10 until one of its ends rests on the stop 18, where it is admittedly also held in a defined position in respect of a direction perpendicular to the window pane 3 as a result of lateral guidance by the walls 19 and 19' (wall 19' being part of the panel portion 1 of the door module), but first remains in an inclined position which is indicated in FIG. 2 by a dotted line. Even if the catch 2 has not yet been positioned and fixed in respect of all the degrees of freedom, the slit 14 thus comes to rest in an area defined by the window pane 3, for which reason fitting the window pane 3 by introducing it into the window lift system is also possible here without any problem. The catch 2 is then, as the window pane 3 is introduced, or more exactly as the lower edge 15 of the window pane 3 travels into the slit 14 in the catch 2, pressed by the window pane 3 itself into the lowermost position which corresponds to a fully opened window once the window pane 3 is fitted and in which connection of window pane 3 and catch 2 can take place in the manner already described. Depending on the dimensions and relative arrangement of the different components of a window lift system of the described type, with other embodiments it can also be sufficient if the catch 2 is able to be positioned and fixed by the positioning and fixing means only in respect of two or three degrees of freedom.

Figure 3:
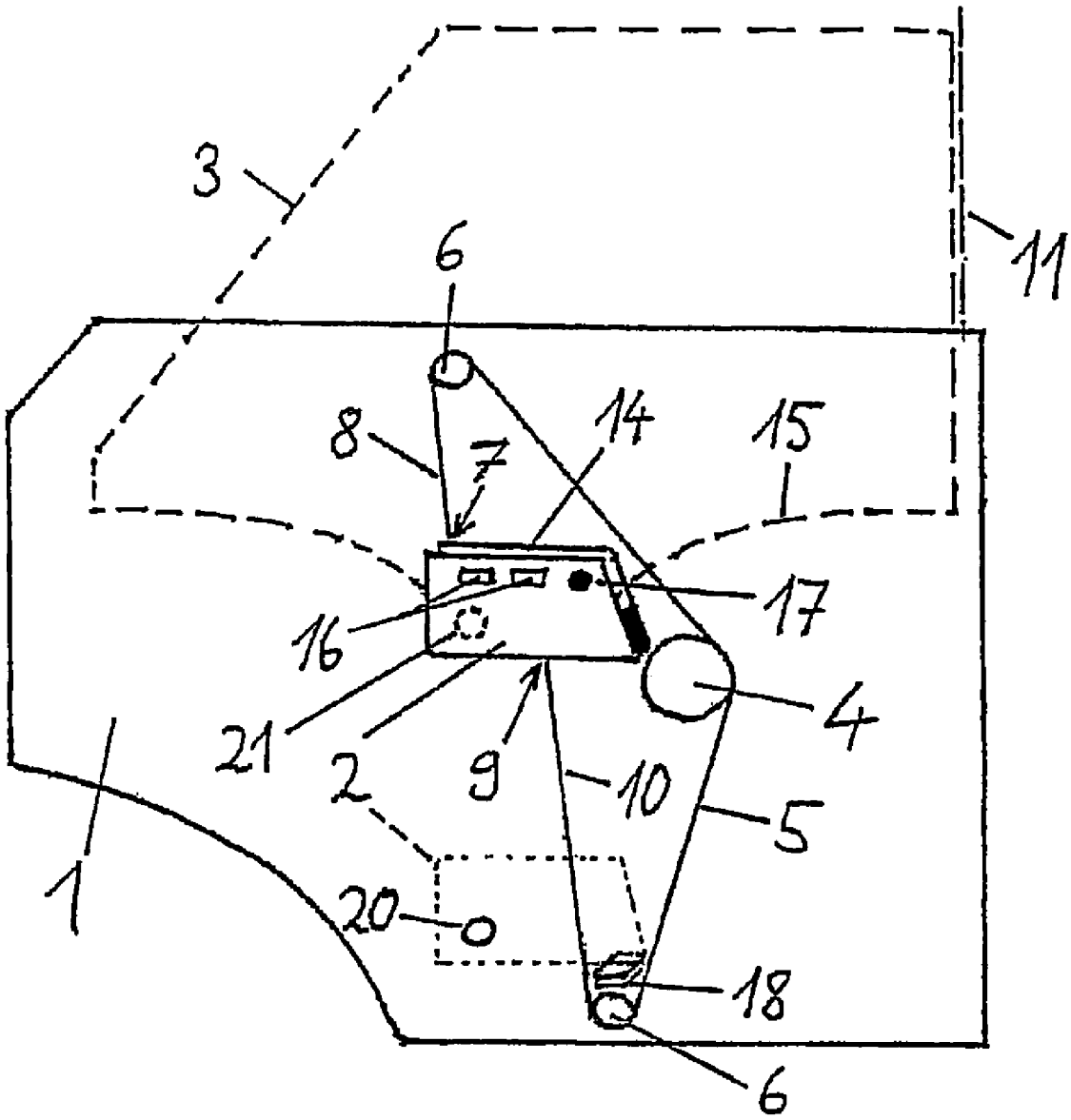
FIG. 3 shows a further modification of a window lift system according to the present invention on a door module.

A further embodiment of the invention is finally illustrated in FIG. 3. In the window lifting device depicted there and arranged again on a panel part 1 of a door module, the means for positioning and fixing the catch 2 include, beside a lower stop 18, an opening 20 in the panel part 1 and a corresponding opening 21 in the catch 2, this corresponding opening 21, which is indicated in a broken line in FIG. 3, being designed merely as a depression on a side of the catch 2 facing the panel part 1. The openings 20 and 21 are so arranged that they face one another when the catch 2 assumes its lowermost position which is indicated in FIG. 3 again by a dotted line. For positioning and fixing the catch 2 in the lowermost position, which serves as the fitting position during the fitting of the window pane 3, a pin, which is not indicated in FIG. 3, can be inserted from the dry side through the opening 20 in the panel part 1 into opening 21. In the depicted embodiment, this pin is provided as a headless screw, the opening 20 in the panel part 1 being provided with a thread matching this headless screw. The catch 2 can therefore be fixed by the above-mentioned headless screw, produced for example from plastics material, being screwed through the opening 20 in the panel part 1 into the opening 21 in the catch 2. After a window pane 3 has been fitted, i.e. after the introduction of the window pane 3 into the window lift system and connection of the window pane 3 with the catch 2 has taken place in the described manner, the headless screw can then be screwed back until the catch 2 is released and can later be moved up and down with the window pane 3 for opening and closing the window. The headless screw remaining in the opening 20 in the panel part then still serves to seal the opening 20 in the panel part 1 in order to prevent water penetrating into a dry region of the corresponding vehicle door. Removing the headless screw and then sealing the opening 20 with a plug would also be possible. It is possible to proceed in the same manner if, instead of the headless screw, a simple bolt is used as the pin.

In similar embodiments of the invention, a plurality of pins, preferably two, and a corresponding number of openings or depressions in the panel part 1 and in the catch 2 can be provided in order to fix the catch 2 in the described manner, preferably in a position which corresponds to a possible position of the catch 2 once the window pane is fitted. Differently from the embodiment depicted in FIG. 3, this position does not necessarily have to correspond to the lowermost position of the catch 2. In similar embodiments of the invention, provision can also be made for such a screw or such a pin not to be screwed or pushed through the panel part 1 into the catch 2, but through the catch 2 into the panel part 1. Finally, instead of a pin or a screw, another tool can be provided which engages through the opening 20 and can grasp and hold the catch 2.

In the window lift systems illustrated in FIGS. 1 to 3, in each case the window pane 3 is guided on one side by a single guide rail 11. However, rail-free window lifting devices can also be embodied in a completely analogous manner. Finally, other embodiments of the invention can differ from the window lift systems depicted in the figures in that, instead of the single traction cable 5, two independent pulling devices (for example cable pulls or chains) are provided, one of which forms the upwardly pulling end 8 and the other the downwardly pulling end 10.

The invention claimed is:

1. A window lift system, comprising:

a pulling device including one upwardly pulling end and one downwardly pulling end;

only a single catch for a window pane, the catch being moved up and down by the pulling device and being connected to the pulling device only by the one upwardly pulling end and the one downwardly pulling end, the catch having (i) a first fastening point connected to the upwardly pulling end of the pulling device and (ii) a second fastening point connected to the downwardly pulling end of the pulling device, the second fastening point being horizontally off-set from the first fastening point in the window pane plane such that, by means of the upwardly pulling end and the downwardly pulling end, torque is transferred to the window pane pressing the window pane against a guide edge independently of a direction of movement of the window pane when the window pane is fitted; and a positioning arrangement positioning and fixing the catch in respect of at least three degrees of freedom such that the catch is kept in a position defined in respect of said degrees of freedom even when the window pane is not fitted, wherein the positioning arrangement does not prevent the pulling device from transferring the torque to the window pane when the window pane is lifted.

2. The window lift system according to claim 1, wherein the window lift system is utilized for a side window of an automotive vehicle.

3. The window lift system according to claim 1, wherein the positioning arrangement is suitable for positioning and fixing the catch in respect of one of four, five and six degrees of freedom.

4. The window lift system according to claim 1, wherein the pulling device has one of a cable pull and a chain to which the upwardly and downwardly pulling ends belong.

5. The window lift system according to claim 1, wherein the catch has an upwardly opening slit for receiving, a lower edge of the window pane.

6. The window lift system according to claim 1, wherein the catch has at least one locking element for snapping into a recess in the window pane.

7. The window lift system according to claim 1, wherein the catch has at least one opening, a pin being provided to be received as an exact fit by the at least one opening as well as by a recess in the window pane which is aligned with the at least one opening once the window pane is fitted.

8. The window lift system according to claim 1, wherein the positioning arrangement is one of (i) provided by a lower stop for the catch and (ii) including the lower stop.

9. The window lift system according to claim 8, further comprising:

a guiding arrangement laterally guiding the catch at least in a lower movement section in a vicinity of the lower stop.

10. The window lift system according to claim 9, wherein the guiding arrangement includes at least one of walls which guide the catch laterally and a cone on which the catch sits in a lowermost position.

11. The window lift system according to claim 10, wherein the walls converge downwards in a manner of a funnel.

12. The window lift system according to claim 1, wherein the window lift system is provided in a side panel module.

13. The side panel module according to claim 12, wherein the arrangement includes an opening in a panel part of the side panel module and a corresponding opening in the catch, as well as a pin which pushes through these openings for fixing the catch in a defined fitting position.

14. The window lift system according to claim 1, wherein the window lift system is provided in a door module.

15. The door module according to claim 14, wherein the arrangement includes an opening in a panel part of the door module and a corresponding opening in the catch, as well as a pin which pushes through these openings for fixing the catch in a defined fitting position.

16. The window lift system according to claim 1, wherein the window lift system is provided in a side door for an automotive vehicle.

* * * * *